US010816937B2

(12) United States Patent
Sidhu et al.

(10) Patent No.: US 10,816,937 B2
(45) Date of Patent: Oct. 27, 2020

(54) PATIENT SUPPORT APPARATUSES WITH CLOCKS

(71) Applicant: Stryker Corporation, Kalamazoo, MI (US)

(72) Inventors: Anuj K. Sidhu, Kalamazoo, MI (US); Michael Joseph Hayes, Kalamazoo, MI (US)

(73) Assignee: Stryker Corporation, Kalamazoo, MI (US)

( * ) Notice: Subject to any disclaimer, the term of this patent is extended or adjusted under 35 U.S.C. 154(b) by 506 days.

(21) Appl. No.: 15/642,621

(22) Filed: Jul. 6, 2017

(65) Prior Publication Data

US 2018/0017945 A1 Jan. 18, 2018

Related U.S. Application Data

(60) Provisional application No. 62/361,092, filed on Jul. 12, 2016.

(51) Int. Cl.

| | |
|---|---|
| ***G04G 7/00*** | (2006.01) |
| ***A61G 7/012*** | (2006.01) |
| ***A61G 7/05*** | (2006.01) |
| ***G04G 17/08*** | (2006.01) |
| ***A61G 7/018*** | (2006.01) |

(52) U.S. Cl.

CPC ..... *G04G 7/02* (2013.01); *A61G 7/012* (2013.01); *A61G 7/018* (2013.01); *A61G 7/0516* (2016.11); *A61G 7/0527* (2016.11); *G04G 17/08* (2013.01); *A61G 2203/20* (2013.01)

(58) Field of Classification Search

CPC .... A61G 7/018; A61G 7/0527; A61G 7/0516; A61G 7/012; A61G 2203/20; G04G 7/02; G04G 17/08

See application file for complete search history.

(56) References Cited

U.S. PATENT DOCUMENTS 5,805,530 A 9/1998 Youngberg
6,324,586 B1 * 11/2001 Johnson ..... G04G 7/02 342/352
6,496,705 B1 12/2002 Ng et al.
(Continued)

FOREIGN PATENT DOCUMENTS

JP 2010536111 A 11/2010

*Primary Examiner* — David R Hare
*Assistant Examiner* — Alexis Felix Lopez
(74) *Attorney, Agent, or Firm* — Warner Norcross + Judd LLP

(57) ABSTRACT

A patient support apparatus includes a frame, patient support surface, clock, transceiver, and controller. The transceiver communicates with a headwall and/or a local area network. The controller detects the occurrence of an event and sends a message to a server in communication with the local area network in response to the event. The controller updates its estimate of the local time based upon time data received from the server. The controller may also and/or additionally receive first and second time updates from two different sources. When received, the controller updates its estimate of local time based upon at least one of the following: (a) a comparison of its estimate of local time with the time data from the first source; and (b) a comparison of its estimate of local time with the time data received from the second source.

22 Claims, 5 Drawing Sheets

(56) References Cited

U.S. PATENT DOCUMENTS 6,987,965 B2 1/2006 Ng et al.
6,988,215 B2 1/2006 Splett et al.
7,079,977 B2 7/2006 Osorio et al.
7,126,937 B2 10/2006 Crosbie et al.
7,142,154 B2 11/2006 Quilter et al.
7,171,166 B2 1/2007 Ng et al.
7,187,979 B2 3/2007 Haubrich et al.
7,290,037 B2 10/2007 Clark et al.
7,317,941 B2 1/2008 Stomberg et al.
7,321,837 B2 1/2008 Osorio et al.
7,409,022 B2 8/2008 Dai et al.
7,460,955 B2 12/2008 Woz
7,542,485 B2 6/2009 Bingham et al.
7,624,293 B2 11/2009 Osorio et al.
7,920,881 B2 4/2011 Fullam
8,109,921 B2 2/2012 Estes et al.
8,145,247 B2 3/2012 Fullam
8,175,076 B2 5/2012 Pelzek
8,238,377 B2 8/2012 Morrow et al.
8,290,523 B2 10/2012 Shao et al.
8,401,007 B2 3/2013 Thavisri
8,793,402 B2 7/2014 Rodriguez et al.
8,870,853 B2 10/2014 Estes et al.
8,977,431 B2 * 3/2015 Peters ..... A61G 5/10 701/1
8,977,883 B2 3/2015 Imhof et al.
9,046,878 B2 6/2015 Zheng
9,143,250 B2 9/2015 Ryu et al.
2003/0084190 A1 5/2003 Kimball
2004/0073718 A1 4/2004 Johannessen et al.
2009/0081951 A1 3/2009 Erdmann et al.
2009/0088821 A1 4/2009 Abrahamson
2009/0163793 A1 6/2009 Koehler et al.
2009/0177248 A1 * 7/2009 Roberts ..... G06Q 50/22 607/60
2009/0216080 A1 8/2009 Nakamura
2010/0165795 A1 7/2010 Elder et al.
2012/0020191 A1 * 1/2012 Shemesh ..... G04G 7/02 368/47
2012/0151093 A1 * 6/2012 Zheng ..... G04G 7/02 709/248
2012/0215360 A1 * 8/2012 Zerhusen ..... A61G 7/018 700/275
2013/0091631 A1 * 4/2013 Hayes ..... A61G 7/018 5/600
2014/0076644 A1 * 3/2014 Derenne ..... A61G 1/0275 180/19.2
2014/0195057 A1 7/2014 Zerhuzen et al.
2014/0310024 A1 10/2014 Chang
2015/0038939 A1 2/2015 Estes et al.
2015/0150739 A1 * 6/2015 Bhai ..... A47C 27/083 5/710
2015/0186611 A1 7/2015 George et al.
2015/0231006 A1 * 8/2015 Bhimavarapu ..... A61G 7/018 5/621
2016/0038361 A1 * 2/2016 Bhimavarapu ..... A61G 7/05 5/600
2016/0136356 A1 * 5/2016 Ribble ..... G06F 19/3418 604/111
2016/0375219 A1 * 12/2016 Kaikenger ..... A61B 5/11 600/301
2017/0172462 A1 * 6/2017 Alghazi ..... B62K 5/00
2017/0371431 A1 * 12/2017 Kim ..... G04G 17/08
2019/0163964 A1 * 5/2019 Kawamae ..... G06K 9/00228

* cited by examiner

PATIENT SUPPORT APPARATUSES WITH CLOCKS

CROSS-REFERENCE TO RELATED APPLICATIONS

This application claims priority to U.S. provisional patent application Ser. No. 62/361,092 filed Jul. 12, 2016, by inventors Anuj Sidhu et al. and entitled PATIENT SUPPORT APPARATUSES WITH CLOCKS, the complete disclosure of which is incorporated herein by reference.

BACKGROUND

The present disclosure relates to patient support apparatuses—such as beds, stretchers, cots, recliners, and the like—and more particularly to the clocks on board such patient support apparatuses.

Many patient support apparatuses don't include any clocks whatsoever. For those that do, the clock is set locally at the patient support apparatus by an individual. If the patient support apparatus is not battery powered and the electricity goes out, or if the patient support apparatus is battery powered but the battery power is drained, the patient support apparatus loses track of time and must be reset. Further, regardless of whether power ever goes out or not, the clocks drift over time and must be reset.

SUMMARY

According to various aspects of the present disclosure, patient support apparatuses are provided that include one or more clocks. The patient support apparatuses include controllers adapted to automatically ensure that the time displayed on the clocks is accurate, even in situations where the supply of electrical power is terminated to the patient support apparatus. In some embodiments, the patient support apparatuses are able to automatically display the correct time without requiring a technician, or other user, to input information into the patient support apparatus that indicates the time zone, geographic location of the patient support apparatus, and/or daylight savings data.

According to one embodiment of the present disclosure, a patient support apparatus is provided that includes a base, a frame, a patient support surface, a clock, a transceiver, and a controller. The transceiver is adapted to communicate with a local area network and the controller is in communication with the transceiver and the clock. The controller detects an occurrence of an event and sends a message to a server in communication with the local area network in response to the occurrence of the event. The controller further updates a time indicated by the clock based upon time data received from the server.

According to another embodiment of the present disclosure, a patient support apparatus is provided that includes a base, frame, patient support surface, clock, transceiver, and controller. The transceiver communicates with a local area network. The controller receives first time data from a first time source in communication with the local area network and second time data from a second time source in communication with the local area network. The controller updates a time indicated by the clock based upon at least one of the following: (a) a comparison of the time indicated by the clock with the first time data; and (b) a comparison of the time indicated by the clock with the second time data.

According to other aspects, the event includes one or more of the following: (1) power-up of the patient support apparatus; (2) manual activation of a control on the patient support apparatus; (3) a passage of a predetermined amount of time; (4) the plugging in of the patient support apparatus into an electrical outlet; (5) installation of any software or firmware updates; (6) a manual request entered by an authorized individual located at a server; (7) an interruption in electrical power provided to the patient support apparatus; and/or (8) an interruption in electrical power provided to a server that communicates with the patient support apparatus.

In some embodiments, the controller is further adapted to detect an occurrence of a second event and send a second message to a second server in communication with the local area network in response to the occurrence of the second event, to receive second time data from the second server, and to update the time indicated by the clock based upon the second time data received back from the second server.

The second event may occur more frequently than the first event.

The patient support apparatus communicates with the server using one of the following communication protocols: a Network Time Protocol (NTP); a Simple Network Time Protocol (SNTP); and a Precision Time Protocol (PTP); and the patient support apparatus communicates with the second server using none of the foregoing communication protocols.

In some embodiments, the time data includes an indication of the time maintained at the server and the second time data includes an indication of the time maintained at the second server.

The controller, in at least one embodiment, compares the time maintained at the server and the time maintained at the second server and, if the time maintained at the second server does not differ from the time maintained at the server by more than a threshold, sets the time indicated by the clock equal to the time maintained at the second server.

In other embodiments, the server is in communication with at least one Global Positioning System (GPS) satellite.

The controller shares the updated time indicated by the clock with another device in communication with the patient support apparatus, in some embodiments. The controller may share the updated time indicated by the clock with an electronic device using the transceiver, or it may share the updated time using a second and different transceiver.

In any of the embodiments, the time data and/or second time data may include an indication of a time zone in which the patient support apparatus is located.

The controller may be adapted to transmit status data regarding a height of the patient support surface to the server, and/or other patient support apparatus status data.

A user interface is included in some embodiments of the patient support apparatus that allows a user to input a time zone into a memory of the patient support apparatus. The controller adjusts the time data according to the time zone input by the user.

The second time data is received from a headwall located adjacent to the patient support apparatus. The second time data may be received from the headwall by an infrared transceiver. A WiFi transceiver may also be included that receives the first time data.

The first time source, in some embodiments, is a first server in communication with the local area network and the second time source is a second server in communication with the local area network. The second server may comprise software executing on a hardware platform having an installed operating system wherein the operating system provides the second time data to the software server.

The controller may send an error message to the second server if the first time data differs from the second time data by more than a predetermined amount.

In some embodiments, the controller keeps track of when the first time data is received and when the second time data is received, and uses a first amount of elapsed time since the first time data was received and a second amount of elapsed time since the second time data was received when updating the time indicated by the clock.

In any of the embodiments, the patient support apparatus may include one or more of the following: a plurality of siderails movable between raised and lowered positions; an exit detection system adapted to detect when an occupant of the patient support apparatus exits the patient support apparatus; and/or a lift system adapted to change a height of the support surface. The controller may be further adapted to send status messages regarding the siderails, the exit detection system, and/or the lift system to the second server.

Before the various embodiments disclosed herein are explained in detail, it is to be understood that the claims are not to be limited to the details of operation or to the details of construction, nor to the arrangement of the components set forth in the following description or illustrated in the drawings. The embodiments described herein are capable of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the claims to any specific order or number of components. Nor should the use of enumeration be construed as excluding from the scope of the claims any additional steps or components that might be combined with or into the enumerated steps or components.

DETAILED DESCRIPTION OF THE EMBODIMENTS

Figure 1:
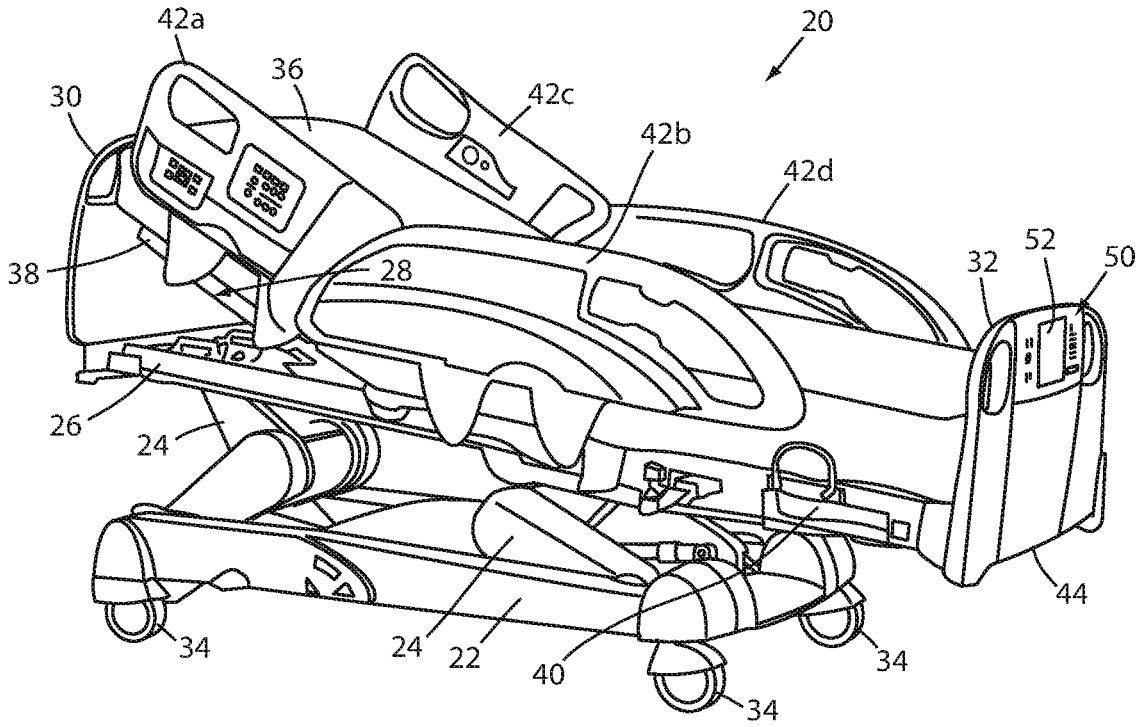
FIG. 1 is a perspective view of an illustrative patient support apparatus according to one aspect of the present disclosure.

An illustrative patient support apparatus 20 according to a first embodiment is shown in FIG. 1. Although the particular form of patient support apparatus 20 illustrated in FIG. 1 is a bed adapted for use in a hospital or other medical setting, it will be understood that patient support apparatus 20 could, in different embodiments, be a cot, a stretcher, a gurney, a recliner, an operating table, or any other structure capable of supporting a person, whether stationary or mobile and/or whether medical or residential.

Patient support apparatus 20 of FIG. 1 includes a base 22, a pair of lifts 24, a frame or litter assembly 26, a patient support surface or deck 28, a headboard 30, and a footboard 32. Base 22 includes a plurality of wheels 34 that can be selectively locked and unlocked so that, when unlocked, patient support apparatus 20 is able to be wheeled to different locations. Lifts 24 are adapted to raise and lower frame 26 with respect to base 22. Lifts 24 may be hydraulic actuators, electric actuators, or any other suitable device for raising and lowering frame 26 with respect to base 22. In some embodiments, lifts 24 operate independently so that the orientation of frame 26 with respect to base 22 may also be adjusted.

Frame 26 provides a structure for supporting deck 28, headboard 30, and footboard 32. Deck 28 provides a surface on which a mattress 36, or other soft cushion, is positionable so that a patient may lie and/or sit thereon. Deck 28 is made of a plurality of sections, some of which are pivotable about generally horizontal pivot axes. In the embodiment shown in FIG. 1, deck 28 includes a head section 38, a foot section 40, and one or more intermediate sections (not labeled). Head section 38, which is also sometimes referred to as a Fowler section, is pivotable between a generally horizontal orientation (not shown in FIG. 1) and a plurality of raised positions (one of which is shown in FIG. 1).

In addition to the aforementioned components, patient support apparatus 20 includes four side rails: a right head side rail 42*a*, a right foot side rail 42*b*, a left head side rail 42*c* and a left foot side rail 42*d*. Siderails 42 are movable between a raised position and a lowered position. In the configuration shown in FIG. 1, all four of the siderails 42 are raised. In some embodiments, patient support apparatus 20 includes a different number of siderails 42 (including none).

The physical construction of any of base 22, lifts 24, frame 26, deck 28, headboard 30, footboard 32, and/or siderails 42 may be the same as disclosed in commonly assigned, U.S. Pat. No. 7,690,059 issued to Lemire et al., and entitled HOSPITAL BED, the complete disclosure of which is incorporated herein by reference; or as disclosed in commonly assigned U.S. Pat. publication No. 2007/0163045 filed by Becker et al. and entitled PATIENT HANDLING DEVICE INCLUDING LOCAL STATUS INDICATION, ONE-TOUCH FOWLER ANGLE ADJUSTMENT, AND POWER-ON ALARM CONFIGURATION, the complete disclosure of which is also hereby incorporated herein by reference; or as embodied in the commercially available S3 bed sold by Stryker Corporation of Kalamazoo, Mich., and documented in the Stryker Maintenance Manual for Stryker's MedSurg Bed, Model 3002 S3, (doc. 3006-109-002 Rev D), published in 2010, the complete disclosure of which is also hereby incorporated herein by reference. The construction of any of base 22, lifts 24, frame 26, deck, headboard 30, footboard 32 and/or siderails 42 may also take on forms different from what is disclosed in these documents.

Figure 2:
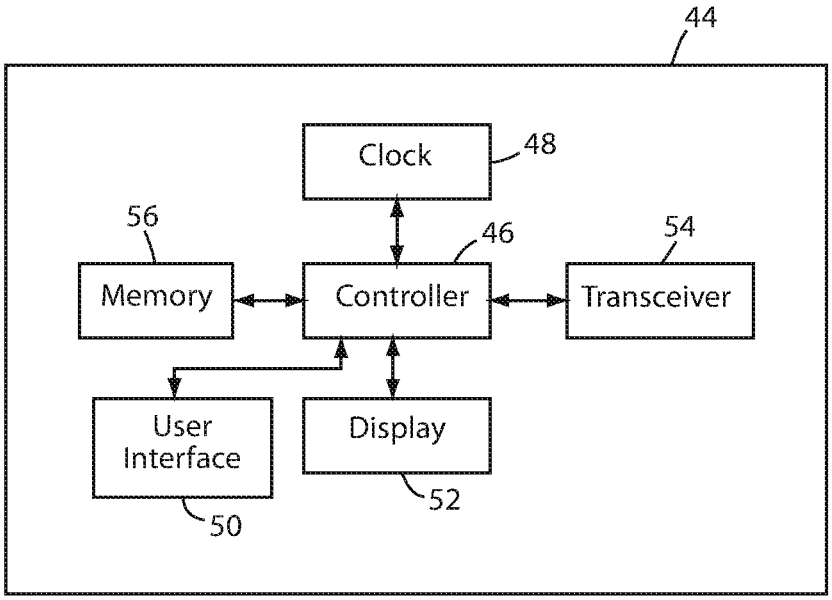
FIG. 2 is a diagram of a control system according to one embodiment that may be implemented into various patient support apparatuses, such as, but not limited to, the one of FIG. 1.

FIG. 2 illustrates a plan view diagram of a control system 44 for patient support apparatus 20. Control system 44 includes a controller 46, a clock 48, a user interface 50, display 52, at least one transceiver 54, and a memory 56. Although not illustrated in FIG. 2, control system 44 also includes one or more actuators and/or sensors for controlling the movement of patient support apparatus 20. In some embodiments, control system 44 also includes one or more batteries for powering one or more of the electrical components of patient support apparatus 20 (such as, but not limited to, clock 48) when the patient support apparatus 20 disconnected from an electrical outlet. Still other components may be included within control system 44.

The components of control system 44 communicate with controller 46 using conventional electronic communication techniques. In one embodiment, controller 46 communicates with clock 48, user interface 50, display 52, and transceiver 54 using I-squared-C communications. Other types of serial or parallel communication can alternatively be used. In some other embodiments, different methods may be used for different components. For example, in one embodiment, controller 46 communicates with user interface 50 via a Controller Area Network (CAN) or Local Interconnect Network (LIN), while it communicates with memory 56 using a Serial ATA bus (SATA), or other type of bus connection.

User interface 50, in the embodiment shown in FIG. 1, is located on footboard 32. User interface 50 includes a plurality of buttons that a caregiver presses in order to control various features of the patient support apparatus 20, such as, but not limited to, raising and lowering the height of frame 26 via lifts 24, pivoting one or more of deck sections 28 via one or more deck actuators, turning on and off a brake (not shown) for wheels 34, controlling a scale system integrated into the patient support apparatus 20, controlling an exit alert system integrated into the support apparatus 20, and/or controlling other features of the patient support apparatus 20.

In the embodiment shown in FIG. 1, display 52 is a touchscreen display capable of displaying text and/or graphics and sensing the location that a users finger touches the display, although it will be understood that display 52 could be modified to be a display without touchscreen capabilities that used hard or soft buttons to interact therewith, or still other types of displays. Further, although display 52 is shown in FIG. 1 as being mounted to footboard 32, it will be understood that display 52 can be mounted at other locations on patient support apparatus 20. Further, more than one display 52 may be present in some embodiments of patient support apparatus 20.

Transceiver 54 establishes a communications link 66 (FIG. 5) that links together transceiver 54 and a healthcare facility computer network 68. In one embodiment, communications link 66 is a WiFi communications link and healthcare facility network 68 is a Local Area Network that utilizes Ethernet connections. In other embodiments, communications link 66 is a wired communications link between transceiver 54 and healthcare network 68. Such a wired connection may be carried out by an Ethernet cable, a serial cable, or by other cables. In still other embodiments, communications link 66 is a wireless link that, in some instances, is carried out through the use of one or more mesh networks that patient support apparatuses 20 are part of. Such use of mesh networks to communicate information from patient support apparatuses 20 to a healthcare network, such as network 68, are disclosed in commonly assigned U.S. patent application Ser. No. 13/802,855 filed Mar. 14, 2013 by applicants Michael Hayes et al. and entitled PATIENT SUPPORT APPARATUS COMMUNICATION SYSTEMS, and commonly assigned U.S. Pat. No. 8,461,982 issued to Becker et al. and entitled COMMUNICATION SYSTEM FOR PATIENT HANDLING DEVICES, the complete disclosures of both of which are hereby incorporated herein in their entirety by reference.

Controller 46 includes one or more microcontrollers, microprocessors, and/or other programmable electronics that are programmed to carry out the functions described herein. It will be understood that controller 46 may also include other electronic components that are programmed to carry out the functions described herein, or that support the microcontrollers, microprocessors, and/or other electronics. The other electronic components include, but are not limited to, one or more field programmable gate arrays, systems on a chip, volatile or nonvolatile memory, discrete circuitry, integrated circuits, application specific integrated circuits (ASICs) and/or other hardware, software, or firmware, as would be known to one of ordinary skill in the art. Such components can be physically configured in any suitable manner, such as by mounting them to one or more circuit boards, or arranging them in other manners, whether combined into a single unit or distributed across multiple units. Such components may be physically distributed in different positions on patient support apparatus 20, or they may reside in a common location on patient support apparatus 20. When physically distributed, the components may communicate using any suitable serial or parallel communication protocol, such as, but not limited to, CAN, LIN, Firewire, I-squared-C, RS-232, RS-485, etc.

Figure 3:
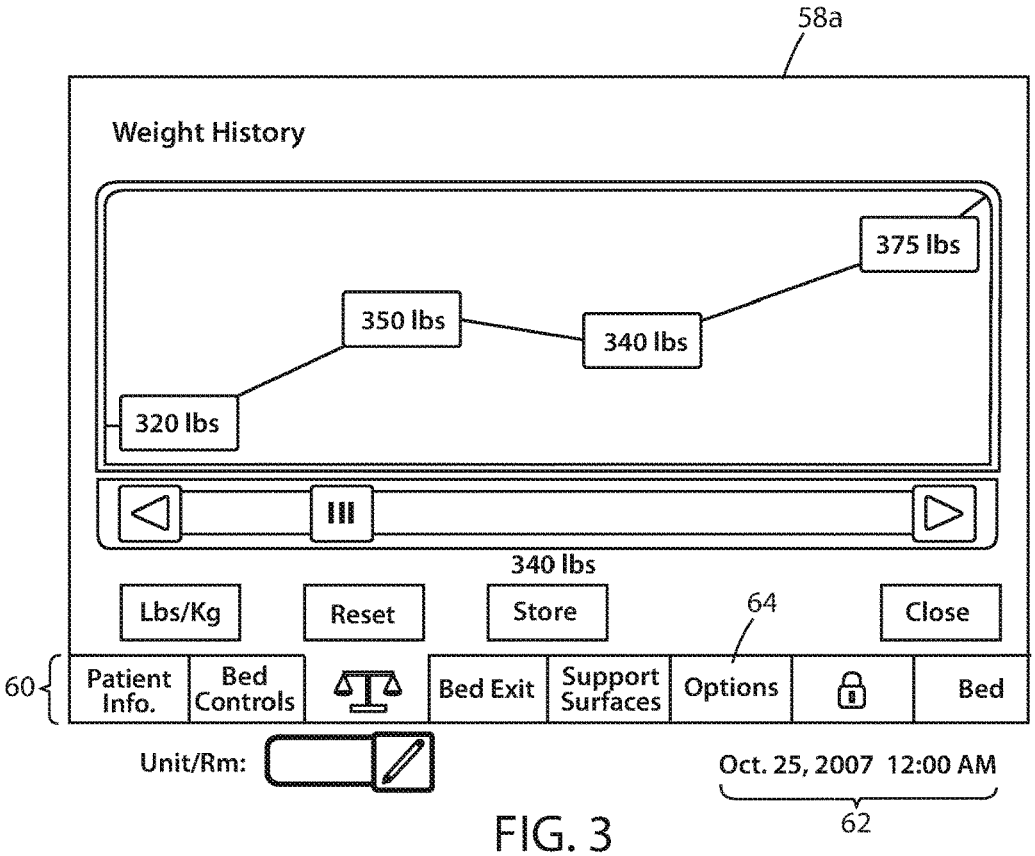
FIG. 3 is an example of a first screen shot that may be displayed on a screen of the patient support apparatus of FIG. 1.

FIG. 3 illustrates an illustrative screen shot 58*a* that is, in some embodiments, displayed on display 52 at various times, depending upon the particular controls that a user has utilized on user interface 50. Screen shot 58*a* shows a weight history of a patient assigned to patient support apparatus 20. Screen shot 58*a* also includes a menu bar 60 and a time and date field 62. Menu bar 60 includes a plurality of functions and features that a user may select from by touching selected areas of menu bar 60. Time and date field 62 displays the current time and date. The time and date displayed in time and date field 62 are under the control of controller 46.

Figure 4:
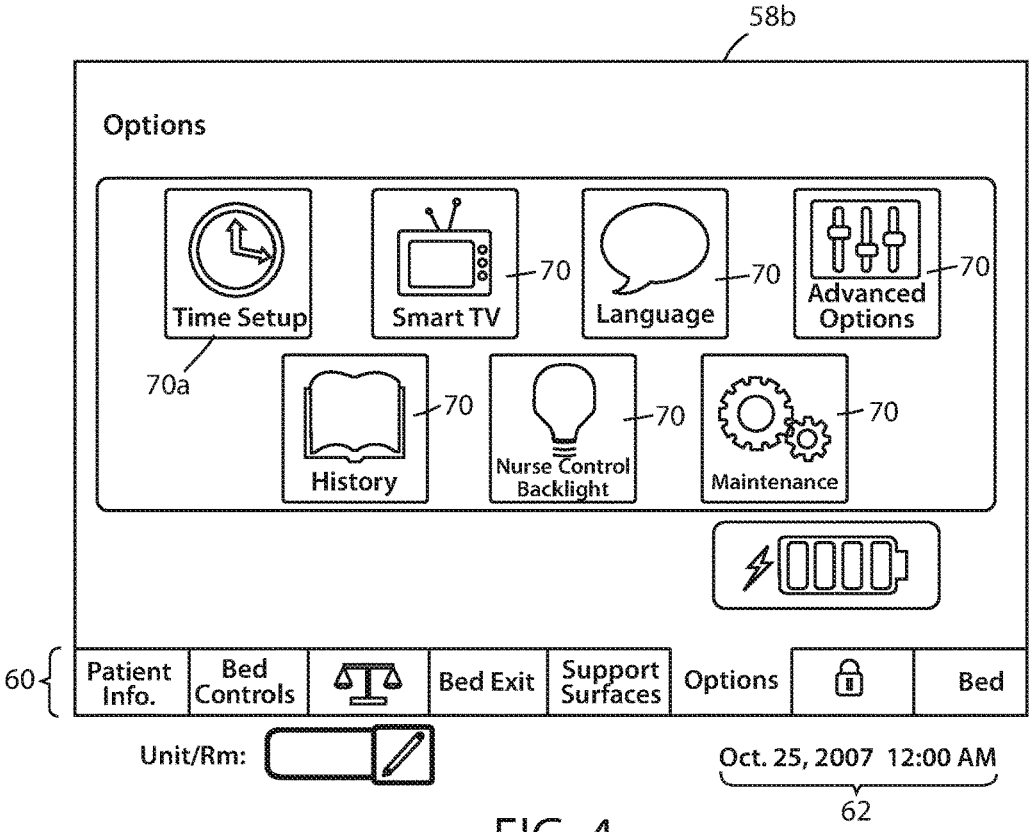
FIG. 4 is an example of a second screen shot that may be displayed on the screen of the patient support apparatus of FIG. 1.

If a user selects an "options" icon 64 on menu bar 60, controller 46 is programmed to display a screen such as is illustrated by screen shot 58*b* of FIG. 4. As can be seen in FIG. 4, screen shot 58*b* includes a plurality of different control icons 70 for controlling various features of patient support apparatus 20. One such control icon 70*a* is adapted to allow a user to control clock 48 and the time and date information indicated in time and date field 62. That is, if a user presses on control icon 70*a*, the user is presented with a display screen that enables the user to control various aspects of clock 48, including, but not limited to, entering information that defines the time zone in which patient support apparatus 20 is located and/or entering daylight saving time information into patient support apparatus 20 that defines the daylight saving time shifts, if any, that are used in the geographic location in which patient support apparatus 20 is currently located. Controller 46 stores this information in memory 56 and utilizes it in any of the various manners described in more detail below.

Controller 46 determines the current time and date for displaying in time and date field 62 by relying upon a combination of the following: (1) time data input into patient support apparatus using user interface 50, (2) time data received via transceiver 54, and (3) time data from clock 48.

Controller 46 receives an estimate of current local time from clock 48 and displays this estimated time in time and date field 62. Clock 48 includes an oscillator, or other comparable structure, suitable for measuring a relative amount of time, but does not in and of itself include a structure for determining an absolute time, such as a time of day, a date, or any adjustments for daylight savings time or time zone data.

A user, however, may use user interface 50 (and a screen brought up in response to selecting control icon 70*a*) to enter into memory 56 any one or more of the following data items: (1) a current time of day; (2) a date; (3) a time zone in which patient support apparatus 20 is currently located in (or an offset from a standard time, such as Universal Coordinated Time); (4) a daylight saving schedule. This information is used by controller 46 to process the output from clock 48. That is, whenever a user enters new time information into memory 56, such as a new date or current time, controller 46 updates a current estimate of local time based upon the newly entered time information.

For example, if the current estimate of local time is 1:34 in the afternoon and a user enters time data indicating that the correct local time is 1:45 in the afternoon, controller 46 resets the current estimate of local time to be 1:45. Alternatively, if the current estimate of local time is 2:45 and the user enters time data indicating that the patient support apparatus has been moved to a new time zone that is one hour earlier, or that daylight savings time has ended, controller 46 resets the current estimate of local time to 1:45. Thereafter, controller 46 keeps track of the current local time by monitoring the outputs from clock 48. Clock 48 provides a measure of how much time passes since it was reset at 1:45 and controller 46 adds this measured elapsed time to the time that was input by the user. Due to the inherent inaccuracies in clock 48, this local estimate of time will drift over extended periods of time. Controller 46 prevents and/or removes these accumulated inaccuracies from its current estimate of local time by communicating with one or more off-board devices. This communication is better understood with respect to FIG. 5.

Figure 5:
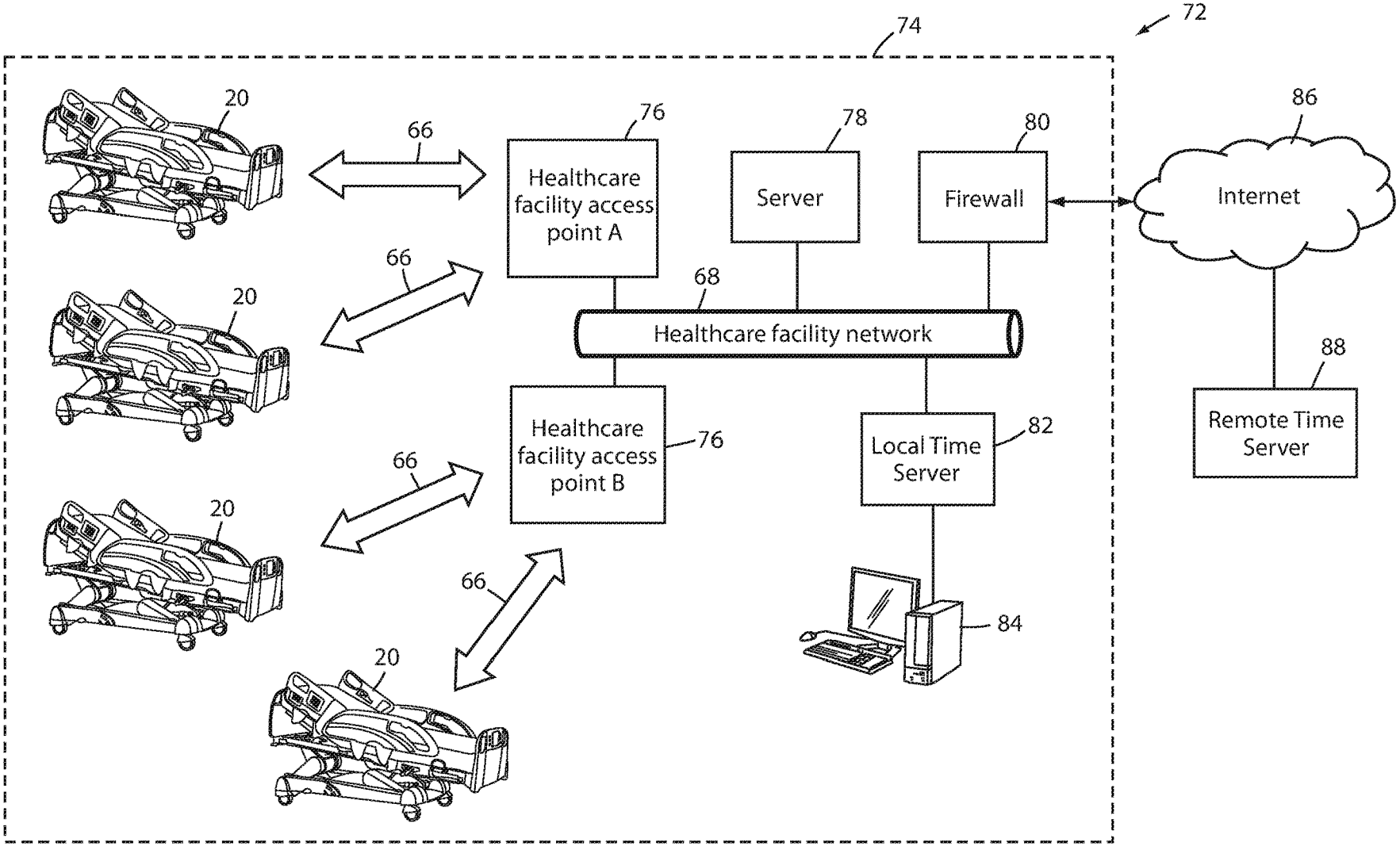
FIG. 5 is an illustrative diagram of a first clock control system utilizing a plurality of patient support apparatuses having the control system of FIG. 2.

FIG. 5 illustrates one embodiment of a clock control system 72. Clock control system 72 is implemented in a healthcare facility 74, such as, but not limited to, a hospital. Such a healthcare facility will typically include a plurality of patient support apparatuses 20. FIG. 5 illustrates four of these, however, it will be understood that the clock control system 72 can be implemented with greater or fewer patient support apparatuses 20 than what is shown in FIG. 5.

Each patient support apparatus 20 communicates with the healthcare facility network 68 via communications link 66, which, as noted previously, may be wired or wireless. Such communication takes places through one or more access points 76. Access points 76 may be WiFi access points, Ethernet ports, or other structures enabling patient support apparatuses 20 to communicate with network 68. In some embodiments, patient support apparatus 20 communicates with network 68 using a Bluetooth communication protocol (IEEE 802.15.1), a ZigBee communication protocol (IEEE 802.15.4), a near field communication protocol (e.g. NFC as standardized by ECMA-340 and ISO/IEC 18092), or an infrared protocol (e.g. RC-5). In still other embodiments, patient support apparatuses 20 communicate with each other directly using any of the aforementioned communication protocols. In some embodiments, a set of one or more patient support apparatuses 20 are configured to communicate with network 68 indirectly by communicating with one or more intermediate patient support apparatuses 20 that are positioned between the set of patient support apparatuses 20 and network 68. Those intermediate patient support apparatuses 20 acts as communication intermediaries between the network 68 and the set of patient support apparatuses 20. One manner of implementing this type of communication is disclosed in commonly assigned U.S. patent application Ser. No. 13/802,855 filed Mar. 14, 2013 by inventors Michael Hayes et al. and entitled PATIENT SUPPORT APPARATUS COMMUNICATION SYSTEMS, the complete disclosure of which is hereby incorporated herein by reference. Still other communication techniques may be used.

Network 68 includes a collection of servers, services, network appliances, and/or other hardware or software that will vary from healthcare facility to healthcare facility. In the example of FIG. 5, healthcare facility 74 includes a server 78 and a firewall 80. These are optional components that may be omitted.

In order to implement some embodiments of clock control system 72, network 68 includes a local time server 82. Local time server 82 includes its own internal clock and provides updates of local time to any and all of the patient support apparatuses 20 that are in communication with network 68. In at least one embodiment, these updates are triggered based upon the occurrence of one or more events. These events include, but are not limited to, the following: (1) the power-up of a patient support apparatus 20; (2) the plugging in of a patient support apparatus 20 into an electrical outlet; (3) any software or firmware updates provided on patient support apparatus 20; (4) a manual request entered by an authorized individual locally at patient support apparatus 20 to update the time on patient support apparatus 20; (5) a manual request entered by an authorized individual at a server user interface 84 that is in communication with local time server 82; (6) an interruption in electrical power provided to patient support apparatus 20 or server 82; (7) the activation of the CPR drop mechanism on a patient support apparatus 20 (which quickly lowers the head section 38 to a substantially flat orientation); (8) the commencement and/or termination of a particular treatment of a patient associated with a patient support apparatus 20; and/or (9) a passage of a predetermined period of time (which may range from multiple times a minute to once a day). These events allow the clocks 48 of patient support apparatuses 20 to synchronize their time to that maintained at local time server 82.

By providing an estimate of local time to each patient support apparatus 20 within healthcare facility 74, local time server 82 eliminates the need for any individual to manually enter time information into each patient support apparatus 20. Thus, although some patient support apparatuses 20 may be configured to allow a user to enter time data, such as a current time, date, time zone offset, daylight savings time info, etc., this information can be provided by local time server 82 to each patient support apparatus using communications links 66. Controller 46 of each patient support apparatus 20 uses the time data received from local time server 82 in the same manner as any local time data received via the patient support apparatus's user interface 50. That is, controller 46 updates its estimate of local time, as appropriate, based upon the received time data. Once updated, controller 46 maintains this estimate of local time using clock 48. Controller 46 continues to rely upon clock 48 for this estimate of local time until a subsequent update of time data is received, either from local time server 82 or from the user interface 50 of patient support apparatus 20.

Local time server 82 may be configured in at least six different manners. Each of these configurations differs in how local time server 82 receives its time data. In a first configuration, local time server 82 receives time data that is manually input by an authorized individual using one or more server user interfaces 84. The authorized individual need only enter time data once into local time server 82 and local time server 82 will propagate this time data to all of the patient support apparatuses 20 that are in communication with local time server 82 via network 68. The time data entered by the authorized individual can be an update of the current local time, the current date, the time zone in which healthcare facility 74 is located in, and/or daylight saving data that is applicable to the healthcare facility 74. Local time server 82 therefore provides a centralized apparatus for synchronizing the local time estimates of all of the patient support apparatuses 20 without requiring an individual to visit each patient support apparatus 20 within facility 74.

When local time server 82 is configured in a second manner, it receives its time data automatically from a time source that is part of network 68. For example, in some embodiments, local time server 82 is installed on hardware that executes an operating system, such as, but not limited to, a Windows® based operating system marketed by Microsoft Corporation of Redmond, Wash., USA. Such operating systems automatically include a time service, such as, but not limited to, the Network Time Protocol (defined in the Internet Engineering Task Force (IETF) Request for Comments (RFC) 5905 (version 4)) or the Simple Network Time Protocol (SNTP). As one example, the operating system may include a Network Time Protocol daemon (ntpd) that maintains time synchronization with one or more remote time servers (e.g. remote time server 88). Regardless of the specific protocol used to obtain its time information, local time server 82 receives its time data from a daemon, utility, or other component of the operating system on which local time server 82 runs. In some of these embodiments, the operating system's time service does not include information regarding the time zone in which healthcare facility 74 is located and/or daylight savings time data. In those instances, an authorized individual can enter this information into local time server 82 using time server interface 84. Local time server 82 stores this entered information in memory and uses it to make adjustments to the time information received from the operating system. The adjusted time is then forwarded to patient support apparatuses 20. Such forwarding is triggered by any one or more of the aforementioned events.

When local time server 82 is configured in a third manner, it receives its time data from a remote time server 88 that is hosted on the Internet 86 (FIG. 5). Most healthcare facilities include a healthcare facility network, such as network 68, that is coupled to the Internet 86. When coupled to the Internet, local time server 82 is able to receive time updates from any of a plurality of time servers (e.g. time server 88) that are hosted on the Internet. For example, in one embodiment, remote time server 88 is an NTP time server, which may be a stratum 0, stratum 1, or stratum 2 NTP time server. An example of such NTP time servers includes the National Institute of Standards and Technology's (NIST's) Internet Time Service servers. These servers are located throughout the United States, including Maryland, Michigan, Colorado, Oregon, and other states. In other embodiments, local time server uses a Precision Time Protocol (PTP) (IEEE 1588-2002 or 1588-2008) to update the times of clocks 48 on patient support apparatuses 20. In still other embodiments, a different time communication protocol besides NTP, SNTP, or PTP is used to synchronize local time server 82 with a source of accurate time, such as remote time server 88.

When local time server 82 is configured in a fourth manner, it receives its time data from a Global Positioning System (GPS) receiver that is in communication with local time server 82. The GPS receiver may be directly coupled to local time server 82, or it may be coupled to network 68 such that local time server 82 communicates with it via network 68.

When local time server 82 is configured in a fifth manner, it receives its time data from a cellular telephone receiver that communicates with one or more cellular telephone towers. The cellular telephone receiver may be directly coupled to local time server 82, or it may be coupled to network 68 such that local time server 82 communicates with it via network 68.

When local time server 82 is configured in a sixth manner, it receives its time data from an RF receiver that is in communication with an RF-broadcast time service. For example, the National Institute of Standards and Technology broadcasts multiple time signals from Fort Collins, Colo., using the WWVB and WWV radio stations that are based upon an atomic clock. Similar RF-broadcast time services exist in other countries. In order to receive its time data from such an RF-broadcast time service, local time server 82 is either coupled directly to an RF receiver tuned to an RF-broadcast time service, or it communicates with one via network 68.

It will be understood that, although local time server 86 has been described herein as receiving its time data in any one of six different manners, that still other manners may be used for communicating this data to local time server 82. Further, it will be understood that local time server 82 is configured, in at least some embodiments, to receive its time data using a combination of multiple ones of the aforementioned manners. For example, in some embodiments, local time server 82 is configured to receive time data both via manual updates from a user using user interface 84 and via one or more of the other five manners discussed above.

It will also be understood that any of the six previously described manners by which local time server 82 receives its time data can be applied to one or more patient support apparatuses 20. That is, in some embodiments, one or more of the patient support apparatuses 20 include built-in GPS receivers, built in RF-radio receivers tuned to an RF-broadcast time service (e.g. WWVB), and/or built-in cellular telephone receivers. In such embodiments, local time server 82 may be omitted, or it may be included as a redundant source of time info for those patient support apparatuses 20 having built-in GPS, RF, or cellular time receivers, or it may be included if one or more patient support apparatuses 20 do not include such built-in GPS, RF, or cellular time receivers.

In still other embodiments, one or more of patient support apparatuses 20 receive time update information from sources other than local time server 82. In one such embodiment, patient support apparatuses 20 communicate directly with remote time server 88, rather than with local time server 82. In another embodiment, patient support apparatuses 20 communicate with both remote time server 88 and local time server 82. In such embodiments, patient support apparatuses 20 seeks or receive time updates from either or both of these servers 82 and 88 in response to one or more of any of the triggering events previously mentioned. To the extent there exists a disparity in the time estimates received from servers 82 and 88, either with respect to each other, or with respect to the local time estimate maintained on patient support apparatus 20, controller 46 includes one or more algorithms for assigning precedence to the disparate time estimates and/or for resolving such disparities.

In another embodiment, patient support apparatuses 20 receive time update information from access points 76, one or more routers, or some other network appliance or service that is an integral component of network 68. In some cases, patient support apparatuses 20 receive an IP address and time data from a Dynamic Host Configuration Protocol (DHCP) server that dynamically assigns IP addresses to the patient support addresses, such as specified in Request for Comments 5908.

As mentioned previously, in some embodiments, an authorized user enters time zones and/or daylight saving time information for healthcare facility 74 manually into either patient support apparatuses 20 or local time server 82. In other embodiments, patient support apparatuses 20 and/or local time server 82 communicate with an external source of time zone and daylight saving information, such as an Internet Assigned Numbers Authority (IANA)-hosted time zone database. Such communication may take place using the time zone data distribution service described in RFC 7808, or by other methods.

Figure 6:
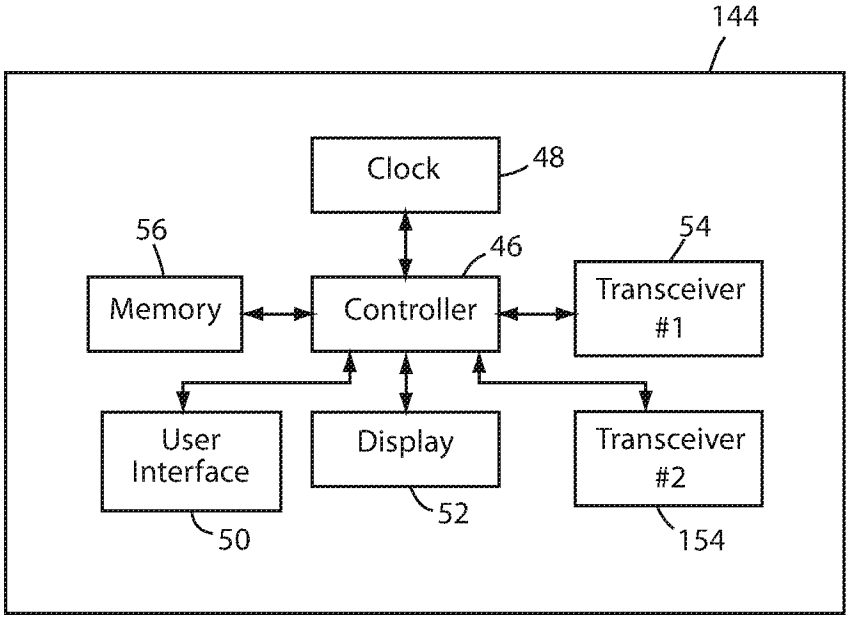
FIG. 6 is a diagram of a control system according to another embodiment that may be implemented into various patient support apparatuses, such as, but not limited to, the one of FIG. 1.

FIG. 6 illustrates a control system 144 according to a different embodiment. Control system 144 may be used on any of patient support apparatuses 20 in place of control system 44. Control system 144 includes a number of components that are the same as components of control system 44. Those common components are labeled with the same reference number and, unless otherwise explicitly stated below, operate in substantially the same manner as the like-numbered components of control system 44. Those components that are new to control system 144 are provided with a new reference number.

Control system 144 differs from control system 44 primarily in that control system 144 includes a second transceiver 154. Second transceiver 154 is a different kind of transceiver than transceiver 54. In one embodiment of control system 144, transceiver 54 is a WiFi transceiver while second transceiver 154 is an infrared transceiver. In this embodiment, each patient support apparatus 20 that incorporates control system 144 receives its time data via user interface 50 and/or second transceiver 154.

Figure 7:
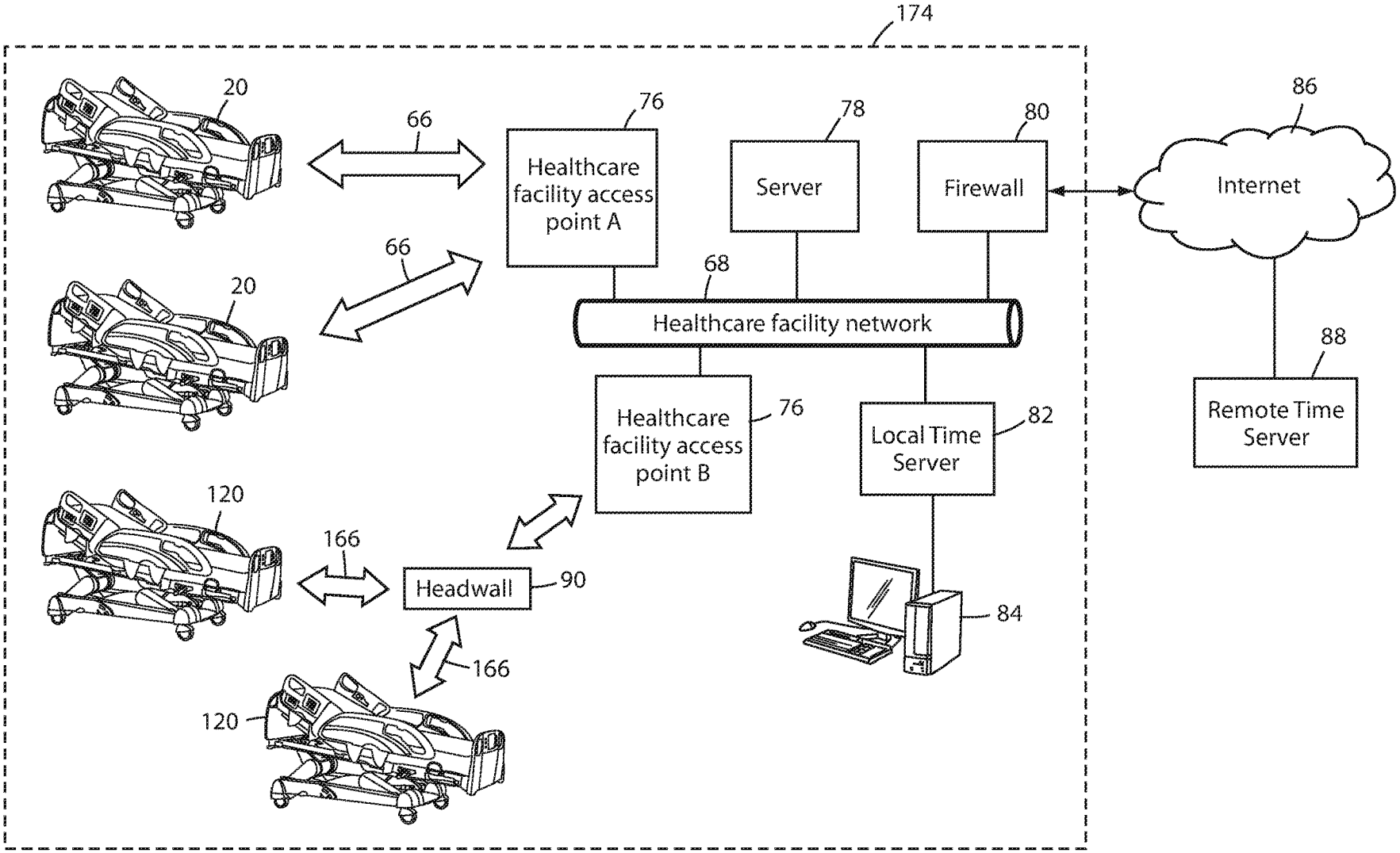
FIG. 7 is an illustrative diagram of a second clock control system utilizing a plurality of patient support apparatuses, some of which include the control system of FIG. 2 and some of which include the control system of FIG. 6.

FIG. 7 illustrates in greater detail one manner in which patient support apparatuses 20 having control system 144 may be incorporated into a healthcare facility 174. As shown in FIG. 7, healthcare facility 174 includes a plurality of patient support apparatuses 20 and 120. Patient support apparatuses 20 are patient support apparatuses that include control system 44. Patient support apparatuses 120 are patient support apparatuses that include control system 144. Patient support apparatuses 120 communicate with a headwall 90 using transceiver 154. This communication takes place over a communications link 166. As noted, in at least one embodiment, transceiver 154 is an infrared transceiver and communications link 166 is an infrared link. Other types of links may be used.

Patient support apparatuses 120 use their transceivers 154 to communicate with headwalls 90 in order to receive information regarding their location within healthcare facility 174. In one embodiment, headwalls 90 transmit a short range signal (e.g. two to ten feet, although other ranges may be used) that includes an identifier that is unique to each particular headwall 90. If a patient support apparatuses 120 is within reception range of this signal, the location of the patient support apparatus 120 can be determined to be substantially the same as the location of the headwall 90 which broadcast the received signal. This location is determined based upon a table that maps the location of each headwall 90 within healthcare facility 174 to the unique identifier corresponding to each headwall 90. This mapping is based upon an initial survey of healthcare facility 174 after headwalls 90 are installed. In some embodiments, headwalls 90 operate in any of the manners disclosed in commonly assigned U.S. patent application Ser. No. 14/819,844, filed Aug. 6, 2015, by inventors Krishna Bhimavarapu et al. and entitled PATIENT SUPPORT APPARATUSES WITH WIRELESS HEADWALL COMMUNICATION, the complete disclosure of which is hereby incorporated herein by reference. Headwalls 90 may operate in still other manners.

Patient support apparatus 120 receives time data from headwalls 90 in addition to location information. That is, patient support apparatuses 120 receive time updates in any of the same manners described above with respect to patient support apparatuses 20 except that patient support apparatuses 120 receive these time updates through headwalls 90, rather than through direct communication with access points 76. Each headwall 90 is in communication with network 68 via one or more access points 76 and receives time update data from local time server 82, remote time server 88, and/or from any of the other sources previously mentioned.

Although FIG. 7 illustrates a healthcare facility 174 having a combination of patient support apparatuses 20 and 120, it will be understood that some healthcare facilities may include only patient support apparatuses 120. Further, in some embodiments, patient support apparatuses 120 may be modified to omit transceiver 54 and only include second transceiver 154. In such modified embodiments, patient support apparatuses 120 do not communicate directly with access points 76 or any other structures of network 68.

In any of the embodiments described above, patient support apparatuses 20, 120, may also communicate status data to a server, such as server 78, that distributes the status data to one or more other applications, servers, or services that are in communication with network 68. Such status data may include information about an exit detection system incorporated into patient support apparatuses 20, 120, or information about any one or more of the following: the status of siderails 42 (raised or lowered); the height of deck 28; whether a brake on the patient support apparatus 20, 120 is activated or not; one or more weight readings taken from a scale system built into patient support apparatus 20, 120; or other status data. In some embodiments, the status data that is communicated by patient support apparatuses 20 is time stamped by controller 46 with the time at which the status data was generated and/or transmitted. Still further, in at least one embodiment, the server to which patient support apparatuses 20, 120, communicate their status data is a server that also incorporates the functionality of local time server 82. In other words, in at least one embodiment, patient support apparatuses 20, 120, communicate their status data to the same server that they receive time information from. That server then distributes the status data to any authorized entity in communication with network 68 that requests the status data.

In any of the embodiments described above, when the patient support apparatus 20, 120, receives time data (whether from a source external to itself, such as local time server 82, or from its own user interface 50), controller 46 compares the received time data to its own estimate of local time and determines the difference, if any, between the two. If the difference exceeds a threshold, controller 46 determines that an error condition exists. Whenever an error condition is determined to exist, controller 46 may display an error message on display 52 and/or it may send an error message to a server, such as server 78, and/or it may undertake one or more other actions. If the difference is less than the threshold, controller 46 changes its estimate of local time to match the time data that it received. Controller 46 maintains a record of all time changes it has made and makes this record available to authorized personnel. In some embodiments, the time data received by patient support apparatus 20 is encrypted such that controller 46 only utilizes the time data if it can be properly decrypted using a key maintained on the patient support apparatus, or by some other method.

In some embodiments, patient support apparatuses 20 are configured to receive time data from only a single source (e.g. local time server 82 or remote time server 88). However, as noted previously, in other embodiments patient support apparatuses 20, 120 are adapted to receive time data from multiple sources, such as from both local time server 82 and remote time server 88. In such embodiments, controller 46 compares the time data received from the multiple sources to each other and/or to its own estimate of local time. In some instances, patient support apparatus 20, 120 is programmed to treat one of the time sources as being more reliable and/or accurate than the other. In such instances, controller 46 updates its own estimate of local time with the more accurate or reliable time data. In other instances, controller 46 determines the difference, if any, between the time data received from the multiple sources and determines that an error condition exists if the difference exceeds a threshold. Still further, in some instances, the time data from the different sources arrives at patient support apparatus 20, 120 at different times and controller 46 keeps track of multiple local estimates of time, each one of which is based upon time data from the different sources. If the different estimates differ by more than a predetermined threshold, controller 46 determines that an error condition exists.

For example, if a patient support apparatus 20 receives at 2:34 PM (as indicated by local clock 48) a first time message from local time server 82 indicating that it currently is 2:33 PM, controller 46 compares this time with its local estimate of time and determines that local clock 48 is a minute fast by comparison to local time server 82. In some embodiments, controller 46 does not immediately update its local estimate of time to match the time received from local time server 82, but instead waits for a predetermined amount of time before making such an update, and/or for the occurrence of one or more events (such as any of the events previously mentioned and/or the transmission of a second time estimate from local time server 82 and/or remote time server 88). While waiting, controller 46 generates and updates a second estimate of local time that is based upon the time received from local time server 82 (the first estimate of local time is based upon the time indicated by local clock 48). If the patient support apparatus 20 receives a second time message from remote time server 88 at 2:40 (as indicated by local clock 48) and the second time message indicates it is currently 2:45 PM, controller 46 determines that local clock 48 is 5 minutes slow with respect to remote time server 88. Further, based upon the time message previously received from local server 82, controller 46 determines that remote time server 88 is likely six minutes fast as compared to local time server 82. In such situations, controller 46 resolves this disparity in whichever manner it has been programmed to, taking into account the relative trustworthiness levels assigned to each source of time, the amount of time that has passed since it last updated it local estimate of time, the source of time that caused it to last update it local estimate of time, and/or other factors.

In yet another embodiment where patient support apparatus 20, 120 receives time data from multiple sources, controller 46 keeps track of when the time data from each source is received and computes an amount of elapsed time since each piece of time data was received. This elapsed amount of time is used, in some embodiments, by controller 46 when determining whether to adjust its estimate of local time based upon the received time data or not. In some embodiments, controller 46 does not update its estimate of local time based upon the received time data if the difference between the received time data and the current estimate of local time is smaller than a threshold. This may be done in situations where there is only a minor difference in the current estimate of local time and the received time data, particularly if the patient support apparatus 20 has previously received updated time data recently.

In some embodiments, patient support apparatus 20, 120 is adapted to act as a source of time information for one or more external devices that are positioned in the vicinity of patient support apparatus 20. In such embodiments, patient support apparatus 20, 120, includes a port or transceiver that enables patient support apparatus 20, 120 to communicate with such external devices. The transceiver may be the same as transceiver 54 or 154, or it may be a different transceiver. Patient support apparatus 20 then shares its estimate of local time with the one or more external devices. Such external devices may include a powered mattress 36, a deep vein thrombosis treatment device, a ventilator, and/or one or more other devices used in the treatment of a patient assigned to patient support apparatus 20, 120, another patient support apparatus 20 that does not have access to network 68 another patient support apparatus 20 that does have access to network 68 but temporarily or permanently sets its local time using data received from another patient support apparatus 20, or still other devices. The communication of the time information from patient support apparatus 20 to one or more of these external devices takes place using any of the aforementioned communication protocols.

Although patient support apparatuses 20, 120 have been primarily described herein as being beds, it will be understood that they may take on different forms. For example, patient support apparatuses 20, 120, may be implemented as recliners, such as the recliners disclosed in commonly assigned U.S. patent application Ser. No. 14/984,403, filed Dec. 30, 2015, by inventors Anish Paul et al. and entitled PERSON SUPPORT APPARATUS WITH PIVOTING BACKREST, the complete disclosure of which is incorporated herein by reference. Other types of recliners may, of course, be used.

In another embodiment, one or more servers coupled to network 68 include a user interface (such as, but not limited to, a keyboard and display) that enables a user to manually send a message to all (or a selected subset) of the patient support apparatuses 20 instructing them what time it is and to update their local clocks 48 to the transmitted time. This enables an administrator, or other authorized personnel, to manually set the clocks 48 on all (or a selected subset) of the patient support apparatuses 20 at once from a single location.

In still another embodiment, local time server 82 is integrated into one or more patient support apparatuses 20. In such an embodiment, the one or more of patient support apparatuses 20 that include local time server 82 provide the functions described above to the other patient support apparatuses 20 that do not include local time server 82. The one or more patient support apparatuses 20 that include the local time server 82 may receive time updates in any of the manner discussed above with respect to local time server 82.

Still further, in some embodiments, one or more of patient support apparatuses 20 may act as user interfaces 84 for local time server 82. In such instances, an authorized individual can use user interface 50 on the patient support apparatus 20 to control one or more aspects of local time server 82. In other words, user interfaces 50 can act, in some embodiments, as not only a user interface for the patient support apparatus 20 to which the user interface 50 is coupled, but also as a user interface for local time server 82.

Various additional alterations and changes beyond those already mentioned herein can be made to the above-described embodiments. This disclosure is presented for illustrative purposes and should not be interpreted as an exhaustive description of all embodiments or to limit the scope of the claims to the specific elements illustrated or described in connection with these embodiments. For example, and without limitation, any individual element(s) of the described embodiments may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Any reference to claim elements in the singular, for example, using the articles "a," "an," "the" or "said," is not to be construed as limiting the element to the singular.

What is claimed is:

1. A patient support apparatus comprising:

a base;

a frame supported on the base;

a patient support surface supported on the frame;

a clock;

a first transceiver adapted to communicate with a local area network;

a second transceiver adapted to communicate with an external device without utilizing the local area network; and a controller in communication with the first transceiver, the second transceiver, and the clock, the controller adapted to detect an occurrence of an event and to send a message to a server in communication with the local area network in response to the occurrence of the event using the first transceiver, the controller further adapted to receive time data from the server in response to the message, to update a time indicated by the clock using the time data received from the server, and to provide the updated time to the external device using the second transceiver.

2. The patient support apparatus of claim 1 wherein the controller is also adapted to transmit status data regarding a height of the patient support surface to the server.

3. The patient support apparatus of claim 1 wherein the event includes one or more of the following: (1) power-up of the patient support apparatus; (2) manual activation of a control on the patient support apparatus; and (3) a passage of a predetermined amount of time.

4. The patient support apparatus of claim 1 wherein the controller is further adapted to detect an occurrence of a second event and send a second message to a second server in communication with the local area network in response to the occurrence of the second event, to receive second time data from the second server, and to update the time indicated by the clock based upon the second time data received back from the second server.

5. The patient support apparatus of claim 4 wherein the second event occurs more frequently than the event.

6. The patient support apparatus of claim 4 wherein the controller is adapted to update the time indicated by the clock based upon a comparison of the time data to the second time data.

7. The patient support apparatus of claim 6 wherein the server executes one of the following communication protocols: a Network Time Protocol (NTP); a Simple Network Time Protocol (SNTP); and a Precision Time Protocol (PTP).

8. The patient support apparatus of claim 6 wherein the server is in communication with at least one Global Positioning System (GPS) satellite.

9. The patient support apparatus of claim 4 wherein the time data includes an indication of the time maintained at the server and the second time data includes an indication of the time maintained at the second server, and wherein the controller is adapted to compare the time maintained at the server and the time maintained at the second server and, if the time maintained at the second server does not differ from the time maintained at the server by more than a threshold, to set the time indicated by the clock equal to the time maintained at the second server.

10. The patient support apparatus of claim 1 wherein the time data includes an indication of a time zone in which the patient support apparatus is located.

11. The patient support apparatus of claim 4 wherein the second time data includes an indication of a time zone in which the patient support apparatus is located.

12. The patient support apparatus of claim 4 in which the time data does not take into account a time zone in which the patient support apparatus is located, but the second time data does take into account the time zone in which the patient support apparatus is located.

13. The patient support apparatus of claim 4 wherein the patient support apparatus communicates with the server using one of the following communication protocols: a Network Time Protocol (NTP); a Simple Network Time Protocol (SNTP); and a Precision Time Protocol (PTP); and the patient support apparatus communicates with the second server using none of the foregoing communication protocols.

14. The patient support apparatus of claim 1 further including a user interface adapted to allow a user to input a time zone into a memory of the patient support apparatus, the controller adapted to adjust the time data according to the time zone input by the user.

15. The patient support apparatus of claim 1 wherein the time data received from the server is forwarded from the server to a headwall located adjacent to the patient support apparatus and the headwall forwards the time data to the patient support apparatus.

16. A patient support apparatus comprising:

a base;

a frame supported on the base;

a patient support surface supported on the frame;

a clock;

a transceiver adapted to communicate with a local area network; and a controller in communication with the transceiver and the clock, the controller adapted to receive first time data from a first time source in communication with the local area network in response to a first event and to receive second time data from a second time source in communication with the local area network in response to a second event, wherein the second event occurs more frequently than the first event, and wherein the controller is further adapted to determine a first difference between the time indicated by the clock and the first time data, to determine a second difference between the time indicated by the clock and the second time data, and to update a time indicated by the clock based upon at least one of the first or second time differences.

17. The patient support apparatus of claim 16 wherein the first time source is an NTP server in communication with the local area network and the second time source is a software server executing on hardware on which an operating system is installed, and the software server obtains the second time data from the operating system.

18. The patient support apparatus of claim 17 wherein the controller is adapted to send an error message to the second server if the first time data differs from the second time data by more than a predetermined amount.

19. The patient support apparatus of claim 17 wherein the first server is located remotely from the local area network and the second server is located on the local area network.

20. The patient support apparatus of claim 17 further comprising:

a plurality of siderails movable between raised and lowered positions;

an exit detection system adapted to detect when an occupant of the patient support apparatus exits the patient support apparatus; and wherein the controller is further adapted to send status messages regarding the siderails and the exit detection system to the second server;

wherein the first time source is a wireless access point of the local area network; and wherein the controller receives time zone data from at least one of the first and second time sources.

21. The patient support apparatus of claim 17 further including a user interface adapted to allow a user to input a time zone into a memory of the patient support apparatus, the controller adapted to adjust at least one of the first time data and second time data according to the time zone input by the user.

22. The patient support apparatus of claim 17 wherein the second time source is a headwall located adjacent to the patient support apparatus; wherein the patient support apparatus further includes a second transceiver different from the transceiver and the controller receives the first time data via the transceiver and the second time data via the second transceiver; and wherein the transceiver is a WiFi transceiver and the second transceiver is an infrared transceiver.

* * * * *